US005094389A

United States Patent [19]

Giroux et al.

[11] Patent Number: 5,094,389

[45] Date of Patent: Mar. 10, 1992

[54] INSTALLATION FOR ELECTROSTATIC APPLICATION OF CONDUCTIVE COATING PRODUCT

[75] Inventors: Patrice Giroux, Saint Egreve; Jean C. Rey, Echirolles, both of France

[73] Assignee: Sames, S.A., Meylan, France

[21] Appl. No.: 606,730

[22] Filed: Oct. 31, 1990

[30] Foreign Application Priority Data

Nov. 14, 1989 [FR] France ..... 89 14912

[51] Int. Cl.[5] ..... B05B 5/16

[52] U.S. Cl. ..... 239/690; 239/691; 118/629; 361/228

[58] Field of Search ..... 239/690, 691; 118/621, 118/629; 361/227, 228

[56] References Cited

U.S. PATENT DOCUMENTS

| | | | |
|---|---|---|---|
| 4,313,475 | 2/1982 | Wiggins | 141/18 |
| 4,629,119 | 12/1986 | Plunkett et al. | 239/690 |
| 4,792,092 | 12/1988 | Elberson et al. | 239/691 |
| 4,884,745 | 12/1989 | Spongh | 239/691 |
| 4,884,752 | 12/1989 | Plummer | 239/691 |
| 4,921,169 | 5/1990 | Tilly | 239/690 |
| 4,932,589 | 6/1990 | Diana | 239/691 |
| 4,962,724 | 10/1990 | Prus et al. | 239/690 |
| 4,993,644 | 2/1991 | Klemm | 239/690 |

FOREIGN PATENT DOCUMENTS

| | | | |
|---|---|---|---|
| 2635990 | 3/1990 | France | 239/690 |
| 2166982 | 5/1986 | United Kingdom | 239/690 |

*Primary Examiner*—Andres Kashnikow
*Assistant Examiner*—Lesley D. Morris
*Attorney, Agent, or Firm*—Spensley Horn Jubas & Lubitz

[57] ABSTRACT

An installation particularly suited to use in the automobile industry for electrostatic application of conductive coating product is partly at a high-tension voltage and partly grounded, these parts being separated by at least one temporary insulating device. The electrostatic sprayer is fed from a first storage tank insulated from ground and the latter is filled in a very short time period with coating product previously stored in a grounded second storage tank, through a temporary insulating device.

11 Claims, 2 Drawing Sheets

INSTALLATION FOR ELECTROSTATIC APPLICATION OF CONDUCTIVE COATING PRODUCT

BACKGROUND OF THE INVENTION

1. Field of the Invention

The invention concerns an installation for electrostatic application of a relatively good conductor coating product such as a water-based paint, for example; it is more particularly concerned with an arrangement for quickly changing coating product in the dead time between presentation of two objects to be coated.

2. Description of the Prior Art

In a coating product application installation in which the objects to be coated are carried by a conveyor past one or (usually) more sprayers there is usually a dead time between the end of application of a coating product to one object and the start of application of an often different coating product to the next object. This dead time corresponds to the distance between the objects on the conveyor. This is the case in the automobile industry in particular, where manufacturing constraints are such that two consecutive bodies on the conveyor generally have to be coated with different coating products. To be able to change the coating product for each object two parallel feed lines to the sprayer(s) are often used so that one can be cleaned and dried and then fed with the next coating product while the other is in use. This results in costly installations, especially for applying conductive coating products requiring autonomous storage tanks electrically insulated from ground.

The conductive coating products are supplied through long closed loop circuits between large storage tanks and the various spray booths. These closed loop circuits are grounded for safety reasons and electrical insulating means must be provided between the parts of the circuit which are grounded and those which are at the high-tension voltage during electrostatic application of the coating product.

The parts at the high-tension voltage include a small autonomous storage tank containing sufficient product to cover one object. Until now the best performing installations of this kind have been unable to execute all the cleaning and coating product change operations in a time less than the dead time defined above, which explains the need for two parallel feed lines.

Cleaning and in particular filling the autonomous storage tanks takes some time. Where several storage tanks must be filled simultaneously with the same coating product, for all the operations to be accomplished within said dead time the coating product circuit would have to supply the tanks in a few seconds with a sufficient quantity of product to feed the sprayers for an entire spraying period. The rate of filling might be approximately ten times greater than the average throughput of the feed to the sprayers. These flowrates would cause significant pressure losses in the feed circuits. What is more, the connections between the sprayer(s) and the coating product manifold connected to the various circuits by selector valves are sometimes relatively long (several meters) because the sprayers are distributed all around the path of the object to be coated. These connections are also of relatively small cross-section to render them flexible, said sprayers being mobile. Consequently, the connections would be affected by significant pressure losses. The autonomous storage tanks farthest from the feed circuits are therefore fed at only a fraction of the initial pressure, which increases the time to fill them.

For all these reasons it has generally been considered necessary to provide two parallel feed lines and to switch alternately between them.

The invention makes it possible to solve this problem by proposing a new arrangement enabling all the autonomous storage tanks to be filled very quickly.

SUMMARY OF THE INVENTION

The invention consists in an installation for electrostatic application of relatively conductive coating product comprising at least one electrostatic sprayer connected to a variable or interruptible high-tension voltage supply, a first storage tank at said high-tension voltage, connected to feed said sprayer and means for filling said first storage tank including parts electrically grounded separated from said first storage tank by at least one pipe member forming a temporary insulating device, said filling means comprising a grounded second storage tank and means for rapidly emptying said second storage tank into said first storage tank through said pipe member forming a temporary insulating device.

For installations operating intermittently with short dead times, it is feasible to carry out all the cleaning and autonomous storage tank filling operations in a very short time, less than said dead time, and consequently to simplify significantly all the distribution, cleaning and isolation circuits.

The invention will be better understood and other advantages of the invention will emerge more clearly from the following description of an installation in accordance with the invention given by way of example only with reference to the appended diagrammatic drawings.

DETAILED DESCRIPTION OF THE INVENTION

Figure 1:
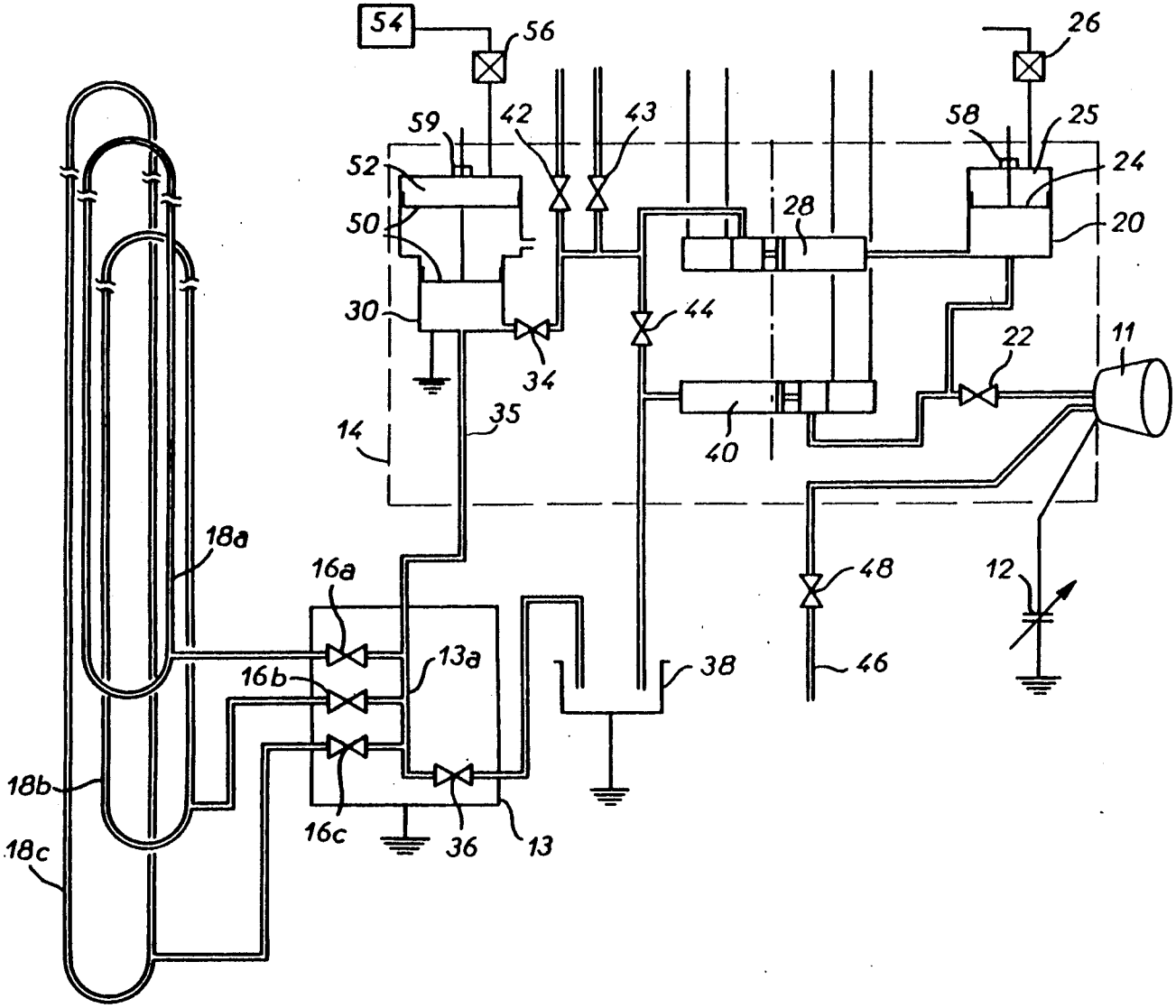
FIG. 1 is a schematic showing a coating product application installation in accordance with the invention.

FIG. 1 shows a coating product application installation including an electrostatic sprayer 11 in the form of a rotating sprayer member connected to a variable or interruptible high-tension voltage supply 12 and fed with coating product via a coating product change unit 13 which is electrically grounded at all times and a sampling unit 14 carried by the same mobile support as the sprayer 11. Said sampling unit 14 is disposed between the sprayer 11 and the output of the coating product change unit 13. The latter comprises a set of valves 16*a*, 16*b*, 16*c*, etc discharging into a common manifold 13*a*. These valves are connected to respective circuits 18*a*, 18*b*, 18*c*, etc for different coating products connected to respective large storage tanks (not shown). The coating product flows continuously and under pressure in a circuit 18 to feed on demand a particular sprayer or group of sprayers connected to a coating product change unit.

The different coating products (specifically, different color products) are electrically conductive. They are water-based paints or metallic paints for example. For safety reasons the large storage tanks, the circuits 18 and each coating product change unit 13 are electrically grounded. The sampling unit 14 has parts that are grounded at all times and others which, because the coating product is conductive, are at the high-tension voltage when the high-tension voltage supply is connected to the sprayer 11, that is to say throughout the spraying of the coating product onto an object.

The parts sequentially connected to the high-tension voltage supply are essentially a first relatively small autonomous storage tank 20, containing sufficient product to feed the sprayer 11 to coat one object, and a valve 22 connected between the outlet of the storage tank 20 and the sprayer 11. The first storage tank 20 contains a piston 24 or like separator member to expel the coating product to the sprayer 11 via the valve 22. The piston delimits inside the storage tank 20 an actuator chamber 25 connected to a source of fluid under pressure by a valve 26. The valve 26 is a vented three-way valve.

The sampling unit 14 includes means for filling the storage tank 20, including parts which are grounded, which are isolated from said first storage tank 20 by at least one pipe member 28 forming a temporary insulating device to be described later. The filling means essentially comprise a second storage tank 30 which is also relatively small (with the same capacity as the first storage tank 20, for example) and is grounded at all times. The outlet from this second storage tank is connected to the pipe member 28 forming the temporary insulating device by a valve 34. One end of the manifold 13*a* of the coating product change unit 13 is also connected to the second storage tank 30 by a flexible pipe 35 which can be relatively long. The other end of this manifold is connected by a valve 36 to waste recovery means 38 which are also grounded.

A second pipe member 40 forming a temporary insulating device is connected between said first storage tank 20 and said waste recovery means 38. Between the valve 34 and the first pipe member 28 are a valve 42 connected to a rinsing product feed pipe, a valve 43 connected to a compressed air feed pipe and a valve 44 establishing the connection with the waste recovery means 38. An (insulative) organic cleaning product feed pipe 46 is connected to the sprayer 11 by a valve 48. The cleaning product in the pipe 46 is used only to rinse the sprayer 11. The piston rod of the piston 24 in the storage tank 20 is coupled to a position sensor 58 so that the flowrate of the coating product to the sprayer 11 can be monitored. The same arrangement is provided for the storage tank 30 whose piston rod is coupled to a position sensor 59.

According to an important feature of the invention the sampling unit 14 comprises means for rapidly emptying the second storage tank 30 into the first storage tank 20 through the pipe member 28. These means are integrated into the construction of the second storage tank, which to this end includes a separator piston 50 delimiting in the storage tank a coating product chamber and an actuator chamber 52 connected to a pressurized fluid (compressed air) supply 54 by a valve 56. The valve 56 is a vented three-way valve. The piston 50 is a two-stage piston.

Figure 2:
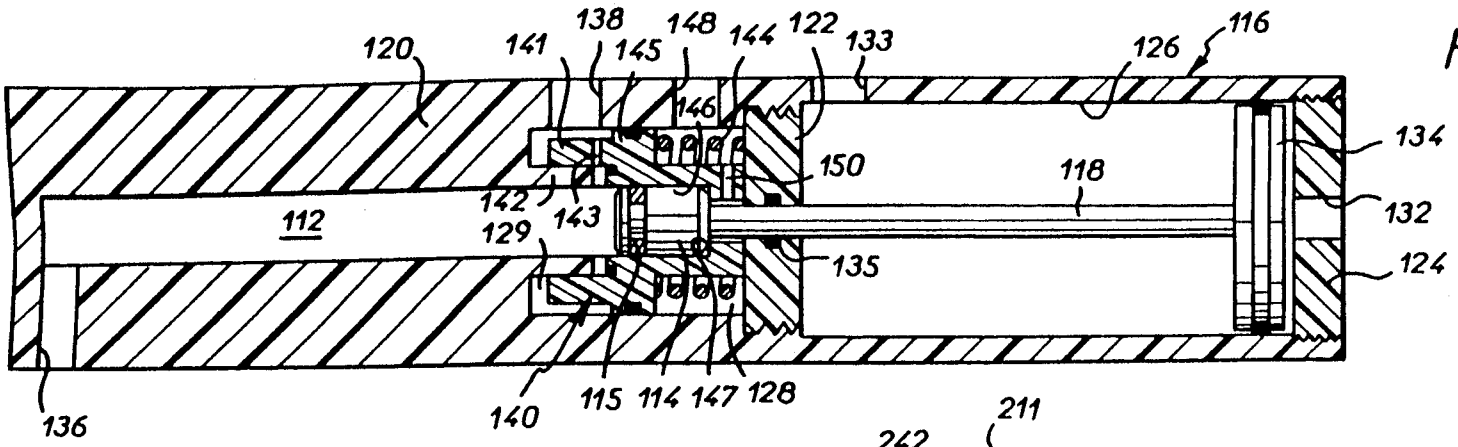
FIG. 2 is a detailed schematic of a pipe member forming a temporary insulating device used in the installation from FIG. 1.

FIG. 2 shows in detail the pipe member 28 or 40 from FIG. 1 forming a temporary insulating device. This device includes a specific length of insulative pipe 112, a piston 114 for scraping the inside wall of this pipe section and means for moving the scraper piston in said pipe section. The scraper piston carries an elastomer O-ring 115 which is pressed against the inside wall of the pipe section. The means for moving the piston comprise a double-acting pneumatic actuator 116 in line with the pipe section 112 with an insulative material rod 118 fixed to said scraper piston 114.

The length of the insulative pipe section 112 is chosen so that the leakage current remains below a chosen value with a given high-tension voltage between its ends provided that the inside surface of said pipe section is scraped sufficiently clean of conductive product. The straight insulative pipe section 112 is defined within a cylindrical block 120 of electrically insulative rigid material which also forms the body of the actuator 116 in line with the pipe section 112. The pneumatic actuator 116 is delimited axially by two plugs 122, 124 screwed into threaded parts of a cylindrical bore 126 in the block 120. The plug 122 separates the actuator from a cylindrical cavity 128 with an annular extension 129 around the pipe section 112. The plug 124 closes an open end of the bore 126 and includes an orifice 132 connected to a compressed air supply (not shown). Another orifice 133 connected to a compressed air supply is provided near the plug 122.

The piston 134 of the actuator 116 moves in the bore 126 between the orifices 132 and 133. The rod 118 is fixed at one end to the piston 134 and passes through the plug 122 which accommodates an O-ring 135 providing a seal between the actuator and the cavity 128. The insulative pipe section 112 is connected direct to an orifice 136 at its end opposite the actuator and communicates with an orifice 138 discharging into the annular extension 129 via an isolating valve 140 near one end of said insulative pipe section 112.

The function of the valve 140 is to prevent the circulation of liquid between the adjacent orifice 138 and the insulative pipe section 112. It is urged at all times towards its closed position and is opened by the scraper piston itself when the latter is near this end of said insulative pipe section 112, in other words when it reaches the end of its travel towards the actuator 116. To this end said isolating valve 140 comprises an insulative annular valve 145 with a cylindrical sleeve 141 sliding on an internal bearing surface 142 of the annular extension 129 of the cavity 128. The orifice 138 communicates with this annular extension 129 and the sleeve 141 comprises a hole 143 through which the liquid can flow.

A seal between the orifice 138 and the pipe portion 112 is provided by the end surface of the bearing surface 142 bearing against the facing surface of the valve 145, which may be provided with a resilient seal. The cavity 128 is coaxial with the pipe section 112 and communicates with it so that the tubular valve 145 is constrained to move in the axial extension of the pipe section 112 of which it constitutes one end. It includes a bore 146 extending the pipe section 112 and having the same diameter as it. The scraper piston 114 enters this bore towards the end of its travel until it abuts a shoulder 147. A spring 144 is fitted in the cavity 128 between the fixed wall 122 and a shoulder on said tubular valve 145. It is prestressed to urge said tubular valve towards its closed position. Said cavity 128 communicates through an orifice 148 with a compressed air supply (not shown). The resulting pressure in the cavity 128 urges the valve 145 towards its closed position. Because of a hole 150 in the valve, this pressure is applied to the rear of the scraper piston, by which is meant the side of the piston which is not in contact with the liquid in the pipe section 112. The piston 114 is therefore acted on by an air pressure opposing the pressure exerted by the liquid in the pipe section 112. This arrangement makes it possible to balance to some degree the pressures to either side of the scraper piston 114 and defines a sort of "air seal" preventing infiltration of liquid along the side wall of the scraper piston and extending the service life of the O-ring 115.

As long as the scraper piston 114 is in the position shown in FIG. 2 (air pressure maintained at the orifice 133 in the actuator 116) it pushes the sliding valve towards the right as seen in FIG. 2 and the passage 143 is open. The conductive liquid can therefore flow between the orifices 138 and 136. To prevent the flow of this liquid and to provide electrical insulation between the two parts of the liquid distribution circuit it is sufficient to interchange the pressure in the two chambers of the actuator 116, which displaces the scraper piston 114. Immediately it begins to move, said scraper piston releases the sliding valve 145 which cuts off the circulation of liquid. The scraper piston 114 then continues to move in the pipe section 112, expelling the liquid and simultaneously cleaning the inside of said pipe so that when it reaches the end of its travel there is in the circuit a portion of insulative pipe scraped sufficiently clean of conductive product to "withstand" a particular high-tension voltage.

The operation of the FIG. 1 installation will now be described.

Assume that the first storage tank 20 is filled with a coating product and that fluid under pressure is fed into the chamber 25. The coating product is therefore expelled towards the sprayer 11 at the high-tension voltage through the open valve 22. The two pipe members 28 and 40 are in respective positions maintaining their pipe members 112 sufficiently clean and dry. The high-tension voltage supply is therefore properly isolated from grounded parts.

During the application of the coating product to an object (an automobile body, for example), which routinely takes around 60 seconds, there is sufficient time to clean and dry the storage tank 30 (which has just been emptied into the storage tank 20 and whose piston 50 is in the bottom position shown in FIG. 1), the coating product change unit 13 and the purge pipe, by injecting the rinsing product and air into these parts through the valves 42 and 43, the valves 34 and 36 being open. The valves 36, 42 and 43 are then closed and the valve 44 and then one of the valves 16*a*, 16*b*, 16*c*, etc are opened with the result that the product travels as far as the closed valve 44. A predetermined quantity of the new product is then fed into the storage tank 30 under the control of the position sensor 59 connected to the piston of the storage tank 30.

The installation remains in this state until the end of the spraying phase, that is to say until the piston 24 in the storage tank 20 has expelled all of the coating product towards the sprayer 11. At this time the volumes to be cleaned and the residual quantities of coating product to be eliminated "to the right" of the pipe members 28, 40 (looking at FIG. 1) are very small. The high-tension voltage is removed and the valve 22 is closed. The pistons 114 are then displaced in the two pipe members 28 and 40 to enable rinsing product and air to flow under the control of the valves 42 and 43 to eliminate traces of the coating product just used in the storage tank and the adjacent pipes. The valve 22 is opened briefly to clean the pipe section between this valve and the sprayer 11.

During this time the sprayer 11 is cleaned by insulative solvent injected through the pipe 46 and the valve 48. The valve 34 is then opened and the rapid transfer of the new coating product from the storage tank 30 to the storage tank 20 begins and continues until the circuit is filled with the new coating product, on the upstream side of the pipe member 40, under the control of the sensor 59 associated with the storage tank 30. The pipe member 40 forming the insulating device is then operated to isolate the storage tank 20 from the waste recovery means 38. The valve 26 is then vented and the rapid transfer of the new product continues by pushing back the piston 24 in the storage tank 20. The two diameters of the two-stage piston 50 and/or the pressure of the fluid from the supply 54 are chosen to achieve the required time to transfer the coating product to the storage tank 20. Specifically, the supply 54 can provide a fluid at a relatively high pressure, if necessary, for example twice the pressure of the other fluids in the installation. The two-stage piston 52 constitutes a pressure amplifier.

At the end of this transfer the displacement of the scraper piston 114 in the pipe member 28 forming the temporary insulating device completes the expulsion of the coating product into the storage tank 20 and simultaneously provides electrical insulation between this storage tank and the sprayer 11. The high-tension voltage is re-applied and a new electrostatic spraying phase on a new object can begin. Because the transfer of the coating product to the storage tank 20 no longer depends on the pressure at which the product is supplied by the coating product change unit 13, the cleaning and the filling of the storage tank 20 can always be completed in a shorter time than the dead time as defined above, during which the high-tension voltage may be reduced to a lower value or disconnected.

Figure 3:
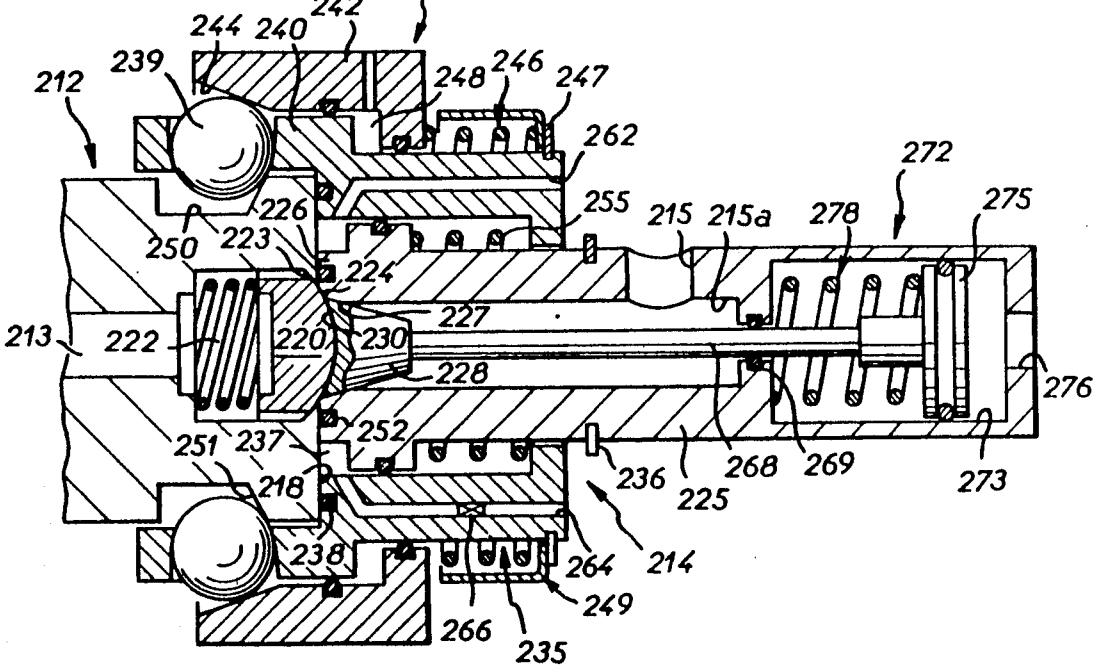
FIG. 3 is a detailed schematic of another embodiment of a pipe member forming a temporary insulating device used in the installation from FIG. 1.

FIG. 3 shows an alternative embodiment of the pipe member forming an insulating device. This embodiment constitutes a mechanically operated quick-release connector 211. In this embodiment the electrical insulation is achieved by separating two parts of said pipe member. It is designed to replace the device 28 from FIG. 1, for example. A similar device could be used to replace the insulating device 40.

The connection device 211 essentially comprises two separable subassemblies, a first connector part 212 in which a fluid outlet 213 is defined and a second connector part 214 in which an entry 215 for the same fluid is defined. Here the entry and the exit are defined relative to the sense in which the device 28 from FIG. 1 is connected. The two connector parts can be assembled together end-to-end in a common axial direction, as shown. The connector part 212 has an annular transverse wall at one end 218 at the center of which is a first valve 220 movable axially inside a cavity communicating with the outlet 213. This valve is urged by a spring 222 towards a seat 223 to isolate the outlet 213. The valve has a spherical dome-shape convex surface 224. When the valve is applied to its seat this convex surface projects slightly beyond the end wall 218.

The connector part 214 includes a tubular member 225 inside which is an axial inlet passage 215*a* communicating with the inlet 215 and one end of which, discharging onto a transverse surface 226 designed to be applied against the end surface 218, comprising a frustoconical part forming the seat 227 of the second valve 228. This arrangement makes it possible to isolate said inlet 215. The generally frustoconical second valve 228 has a spherical dome-shape concave end surface 230 applied to the surface 224 of the valve 220. The two spherical domes preferably have the same radius so that there is virtually no airspace between the two valves, after they are assembled together. However, to ensure proper closing of each valve it is feasible to leave a very small gap between their facing surfaces. In other words, the two valves are provided with respective complementary shape mutually contacting surfaces. They are adapted to be able to move together, remaining in contact, to enable fluid to flow from the inlet 215 to the outlet 213. To this end the outside diameter of the valve 228 is slightly less than the diameter of the orifice in the seat 223 of said first valve so that, if the valve 228 is pushed away from its seat 227, it also separates the valve 220 from its seat 223, enabling fluid to flow between the inlet 215 and the outlet 213. The connector part 214 also includes means for cleaning the two valves and, more generally, all of the interface between the two connector parts.

In the example shown these cleaning means comprise a coaxial member 235 mounted externally on the tubular member 225. These two members can slide axially relative to each other. This sliding is limited by a circlip 236 fixed to the member 225. Said coaxial member 235 is adapted to be applied to and fixed against the end 218 of said first connector part 212. The coaxial member 235 therefore forms a sort of sliding bush while the tubular member 225 includes at its end an exterior member defining with said coaxial member 235 and the end 218 of the first connector part an annular cleaning fluid injection chamber 237. The walls of the chamber 237 are advantageously treated to prevent the fluids used adhering to them, by coating them with polytetrafluorethylene, for example. The cleaning fluid in question is at least one rinsing liquid suited to the nature of the coating product and preferably also compressed air injected after rinsing proper. An O-ring 238 prevents any leakage to the exterior.

The mechanical coupling between the two connector parts is achieved by balls 239 inserted into corresponding holes in a cylindrical skirt 240 of the coaxial member 235. Outside the latter is a tubular blocking member 242 sliding on the coaxial member and incorporating a shallow ramp surface 244 holding the balls into their holes. The blocking member is urged towards the balls by a spring 246 compressed between the blocking member and a circlip 247 fastened to the coaxial member 235. An actuation chamber 248 is defined between the members 235 and 242. Compressed air is injected into this chamber to release the balls. A shouldered bush 249 limits the travel of the member 242 caused by the compressed air. It surrounds the spring 246 and bears on the circuit 247. When the two connector parts are connected together, the balls retained by the blocking member are engaged in an annular groove 250 with one inclined flank 251 on the outside of the connector part 212. This applies the transverse surface 226 against the end 218 of the first connector part, an O-ring 252 being provided between these two surfaces. A spring 255 is mounted between respective shoulders on the coaxial member 235 and the tubular member 225. This spring tends to push the tubular member 225 axially out of the coaxial member 235. When said coaxial member is locked to said first connector part 212, the end of the tubular member 225 is therefore pressed by the spring 255 against the end 218. This defines and delimits the annular chamber 237 when the two connector parts are connected together. The coaxial member 235 includes at least one cleaning fluid (rinsing liquid and/or drying air) inlet passage 262 and a cleaning fluid outlet passage 264. The passages 262 and 264 discharge onto the inside surface of the coaxial member 235 at positions enabling them to communicate with said annular chamber 237. The cleaning fluid outlet passage 264 includes a calibrated flow restriction 266.

The second valve 228 is fixed to a rod 268 which passes axially through a wall 269 separating said inlet passage **215*a* from an actuator 272 in a cylindrical cavity 273 of said second connector part. The rod 268 is fixed to the piston 275 of this actuator. Fluid can be injected through an orifice 276 into one of the chambers of the actuator to urge the piston in a direction tending to separate the valve 228 from its seat 227. A spring 278 is fitted between one axial end of said cavity and the piston in order to urge said second valve 228 towards its closed position, against the seat 227**.

When the two connector parts 212 and 214 are separated the two valves oppose any escape of fluid, the spring 278 in particular applying sufficient force to hold the valve 228 against its seat 227. When the chamber 248 is pressurized to release the balls 239, the two connector parts 212 and 214 may be pushed towards each other. The first effect of this is to apply the O-ring 252 against the end 218 and then to apply the valve 220 against the valve 228 and the surface 226 against the end 218 of the connector part 212. The compression of the spring 255 at the end of this movement enables the end 218 of the connector part 212 to come into contact with the O-ring 238. The depressurization of the chamber 248 enables the spring 246 to urge the coaxial member 235 against the end 218 of the connector part 212, due to the conjugate action of the ramp surface 244, the balls 239 and the inclined flank 251 of the groove 250. The annular chamber 237 is then defined.

If pressure is applied to the actuator 272 through the orifice 276 or if the pressure of the fluid in the passage **215*a* reaches the predetermined value, the valve 228 is separated from its seat 227 and pushes back the valve 220. The fluid can therefore flow from the inlet 215 to the outlet 213. This is what occurs when the coating product is transferred from the storage tank 30 to the storage tank 20**.

To separate the two connector parts all that is necessary is to eliminate the pressure in the actuator 272. The two valves 228 and 220 are applied to their respective seats 227 and 223. Flow of the fluid stops. A rinsing fluid consisting of a mixture comprising a suitable liquid and compressed air, for example, is then fed in through the passage 262 as far as the chamber 237. It is evacuated through the passage 264. Because of the pressure drop caused by the flow restriction 266 the pressure of the rinsing fluid in the chamber 237 is sufficient to overcome the action of the spring 255 and to withdraw the tubular member 225 relative to the coaxial member 235. The rinsing fluid can therefore clean all of the interface surfaces between the connector parts 212 and 214. After drying with air the air pressure is removed and the two connector parts again are in contact. They may then be disconnected from each other mechanically.

Referring again to FIG. 1, the second embodiment of the device just described can be substituted for the pipe member 28. A similar device is substituted for the pipe member 40. All the air and rinsing product feed circuits are provided on the same side as the two connector parts 214, fixed to the sampling device 14. The two mobile connector parts 212 are connected by coiled flexible hoses to the storage tank 20. They are moved simultaneously by an actuator (not shown). During a spraying phase the two mobile connector parts 212 are held away from the two connector parts 214. As in the previous embodiment, the devices 211 can be cleaned and the transfer of the coating product can take place during the above-defined dead time.

Of course, the invention is not limited to the embodiments that have just been described. In particular, two kinds of pipe member forming insulating devices have been described by way of example, suitable for the FIG. 1 installation. Other, more conventional insulating devices may be used, however; in particular, the device may simply consist of a fixed insulative pipe section connected by its two ends to rinsing and drying means enabling the required electrical insulation to be achieved by eliminating any trace of conductive coating product on the inside walls of the pipe section.

We claim:

1. Installation for electrostatic application of relatively conductive coating product comprising at least one electrostatic sprayer connected to a variable or interruptible high-tension voltage supply, a first storage tank at said high-tension voltage, connected to feed said sprayer and means for filling said first storage tank including parts electrically grounded separated from said first storage tank by at least one pipe member forming a temporary insulating device, said filling means comprising a grounded second storage tank and means for rapidly emptying said second storage tank into said first storage tank through said pipe member forming a temporary insulating device.

2. Installation according to claim 1 wherein said second storage tank includes a piston or like separator delimiting an actuation chamber connected by a valve to a pressurized fluid supply and a coating product chamber.

3. Installation according to claim 2 wherein the pressure of said pressurized fluid supply is greater than the pressure of other fluids distributed by the installation.

4. Installation according to claim 2 wherein said separator constitutes a pressure amplifier.

5. Installation according to claim 1 wherein said second storage tank is connected to a coating product change unit.

6. Installation according to claim 1 wherein a first pipe member forming a temporary insulating device is connected between the two storage tanks and a second pipe member forming a temporary insulating device is connected between said first storage tank and grounded waste recovery means.

7. Installation according to claim 6 wherein rinsing product feed means and compressed air feed means are connected between said second storage tank and said first pipe member.

8. Installation according to claim 1 wherein said pipe member forming a temporary insulating device comprises a specific length of insulative pipe with a liquid inlet and a liquid outlet at respective ends, a piston for scraping the inside wall of said pipe section movable therein and means for displacing said scraper piston in said section.

9. Installation according to claim 1 wherein said pipe member forming a temporary insulating device constitutes a quick-release connector.

10. Installation according to claim 9 wherein said quick-release connector comprises:

a first connector part including a first valve urged by spring means towards a first seat to isolate a fluid passage, a second connector part including a tubular member defining another passage and including a second valve urged by spring means towards a second seat to isolate said other passage, respective complementary shape mutually contacting surfaces on said valves which are adapted to be movable together while remaining in contact to enable said fluid to flow, and means for cleaning the mating surfaces of the two connector parts, including those of the two valves.

11. Installation according to claim 1 wherein at least one of said storage tanks includes a piston or like separator for expelling said coating product and said separator is coupled to position sensing means so that the quantity or flowrate of product entering or leaving said storage tank can be determined.

* * * * *